US005467822A

United States Patent [19]

Zwart

[11] Patent Number: 5,467,822

[45] Date of Patent: Nov. 21, 1995

[54] PACK-OFF TOOL

[76] Inventor: Klaas J. Zwart, Drumgarth, Inchgarth Road, Cults, Aberdeen, AB1 9NX, United Kingdom

[21] Appl. No.: 199,236

[22] PCT Filed: Aug. 27, 1992

[86] PCT No.: PCT/GB92/01568

§ 371 Date: Feb. 28, 1994

§ 102(e) Date: Feb. 28, 1994

[87] PCT Pub. No.: WO93/05267

PCT Pub. Date: Mar. 18, 1993

[30] Foreign Application Priority Data

| | | | |
|---|---|---|---|
| Aug. 31, 1991 | [GB] | United Kingdom | 9118693 |
| Apr. 3, 1992 | [GB] | United Kingdom | 9207321 |

[51] Int. Cl.[6] ..... E21B 33/126

[52] U.S. Cl. ..... 166/179; 277/188 A

[58] Field of Search ..... 166/196, 179, 166/118; 277/188 A, 164

[56] References Cited

U.S. PATENT DOCUMENTS

| | | | |
|---|---|---|---|
| 2,138,156 | 11/1938 | Halliburton | 166/179 X |
| 2,565,130 | 8/1951 | Humason | 166/196 X |
| 2,830,540 | 4/1958 | Vincent | 166/196 X |
| 3,227,462 | 1/1966 | Tamplen | 166/196 X |
| 3,433,303 | 3/1969 | Clark et al. | 166/184 |
| 4,032,159 | 6/1977 | Zitting | 277/188 A X |
| 4,428,590 | 1/1984 | Pippert et al. | 277/188 A |
| 4,630,833 | 12/1986 | Boyle et al. | 277/188 A |
| 4,809,989 | 3/1989 | Kernal | 277/164 X |
| 5,096,209 | 3/1992 | Ross | 166/196 X |

FOREIGN PATENT DOCUMENTS

| | | |
|---|---|---|
| 861252 | 2/1961 | United Kingdom . |
| 1283295 | 7/1972 | United Kingdom . |
| 2106957 | 4/1983 | United Kingdom . |
| 2222845 | 3/1990 | United Kingdom . |
| 2236129 | 3/1991 | United Kingdom . |

*Primary Examiner*—Hoang C. Dang

*Attorney, Agent, or Firm*—Bell, Seltzer, Park & Gibson

[57] ABSTRACT

A pack-off tool comprises a main tubular body including an expandable sealing element located between two non-expandable ring members and being mounted on a mandrel and in sealing engagement therewith at axially spaced locations. The tubular body is axially compressible into a radially extended configuration for sealing engagement with a bore wall. A communicating bore extends through the body between the sealing locations. In use, a high pressure on one side of the tool pushes between the high pressure side of the tubular body and the bore wall, through the communicating bore and into a space between the tubular body and the mandrel, and tends to push the other, lower pressure side of the body outwardly into tighter sealing engagement with the bore wall.

11 Claims, 1 Drawing Sheet

PACK-OFF TOOL

Figure 1:
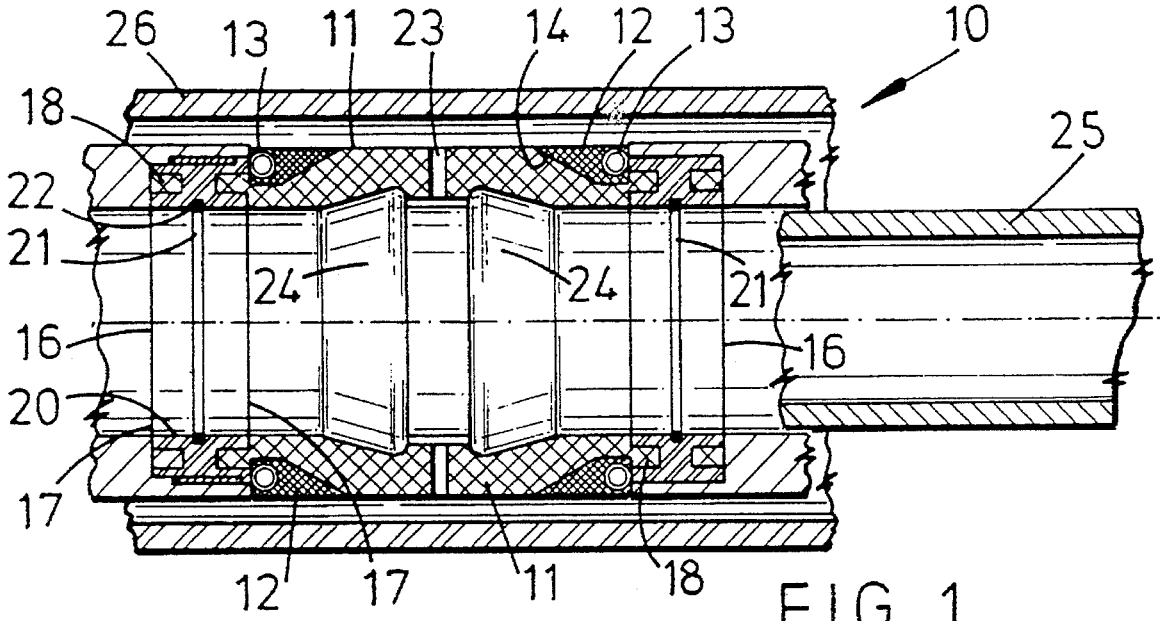

This invention relates to a pack-off tool, and in particular to the pack-off element of such a tool, for use in conjunction with downhole tools such as bridge plugs.

Pack-off elements are used to provide a seal between the inner and outer diameter of co-axial tubes, for example the mandrel of a downhole tool which carries the pack-off element and the well tube against which the element expands when subjected to an axial force.

Examples of downhole tools including such pack-off elements are described in GB-A-1 283 295, GB-A-2 106 957, GB-A-2 222 845 and GB-A-2 236 129.

A disadvantage of such known pack-off elements is that a high axial force is required to provide the necessary expansion and pre-stressing of the element to resist the high pressures which the pack-off elements must contain.

It is among the objects of various aspects of the present invention to obviate or mitigate this disadvantage.

According to one aspect of the present invention there is provided a pack-off tool comprising a main tubular body and a mandrel, the body including an expandable sealing element connected to a non-expandable ring member at one end of the body for reinforcing the end of the element against distortion, and a communicating bore towards the other end of the body and extending through the body, the body being mounted on the mandrel and in sealing engagement therewith at least at said one end, the tubular body being axially compressible to expand the sealing element into a radially extended configuration for sealing engagement with a bore wall and the communicating bore allowing higher pressure fluid from said other end of the tool to enter between the sealing element and the mandrel to exert radial pressure forces on a portion of the sealing element between the bore and the ring member to press the sealing element into tighter sealing engagement with the bore wall.

According to another aspect of the present invention there is provided a method of sealing a bore against a pressure differential comprising the steps:

(a) providing a pack-off tool comprising a main tubular body and a mandrel, the body including an expandable sealing element connected to a non-expandable ring member at one end of the body for reinforcing the end of the element against distortion and defining a communicating bore located towards the other end of the body and extending through the body, the body being mounted on the mandrel and in sealing engagement therewith at least at said one end;

(b) locating the tool in a bore with said other end of the tool oriented towards the higher pressure end of the bore;

(c) applying an initial setting force to the body sufficient to axially compress the sealing element into a radially extended configuration to provide an initial sealing contact with the bore wall; and (d) permitting increasingly higher pressure fluid to flow through the communicating bore from the exterior of the tool to between the sealing element and the mandrel to exert correspondingly increasingly higher radial pressure forces on a portion of the sealing element between the bore and the ring to press the sealing element into tighter sealing engagement with the bore wall such that the resulting sealing contact is capable of withstanding a pressure differential greater than that which could be withstood by said initial sealing contact and which resulting sealing contact corresponds to a sealing contact which, in the absence of said radial pressure forces, would require application of a greater setting force than said initial setting force.

In the preferred embodiment, in which the communicating bore is centrally located in the sealing element, a higher pressure fluid on the other side of the tool pushes between the high pressure side of the tubular body and the bore wall, through the communicating bore and into a space between the tubular body and the mandrel, and tends to push the lower pressure side of the body outwardly into tighter sealing engagement with the bore wall, while the non-expandable ring member controls expansion of the sealing element and in the preferred arrangement maintains the seal between the lower pressure end of the tubular body and the mandrel. Thus, the tubular body effectively reacts to a high pressure on one side of the tool to provide a more effective seal. This arrangement considerably reduces the required degree of initial compression of the body to achieve an effective seal and thus facilitates setting of the tool and allows setting of the tool by means of a slick line. The bore also prevents air becoming trapped between the sealing element and the mandrel while running downhole.

A single expandable sealing element may be provided and the communicating bore may be provided in a central portion of the element. Alternatively, two expandable sealing elements may be provided with a non-expandable element therebetween, in which case the communicating bore may be provided in the non-expandable element.

Preferably, a non-expandable ring member is provided at each end of the expandable sealing element. The provision of two ring members provides additional control over the expansion of the sealing element and permits the tool to be equally effective in sealing a bore against pressure applied from either end. The ring members may be provided with seal means to provide a seal with the mandrel. The seal means are preferably O-ring seals located in annular grooves formed in inner faces of the rings.

Preferably, the ring members define opposed annular surfaces for abutting the sealing element and said surfaces have slots to receive material of the element therein to key the ring members to the sealing element. Axial through holes may be provided in the ring members to receive material of the sealing element therein.

Preferably also, a circular spring member is bonded into the sealing element at or adjacent to each end thereof.

Preferably also, each circular spring member is contained in an end portion of a material which is stiffer than the material of the remainder of the sealing element to aid retraction of the sealing element after use. The stiffer end portions may be bonded to the expandable sealing element and are preferably annular. Most preferably, each end portion is externally mounted on the sealing element and tapers towards the central portion of the sealing element, which is provided with corresponding frusto-conical outer surface portions. It is preferred that the end portions abut a respective ring member.

Figure 2:
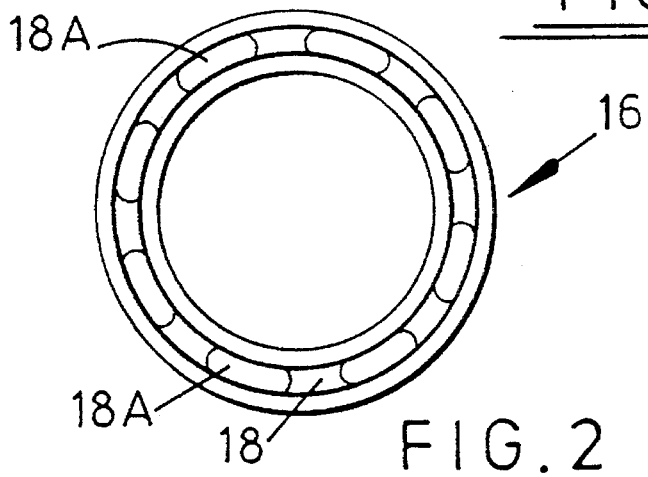
Figure 3:
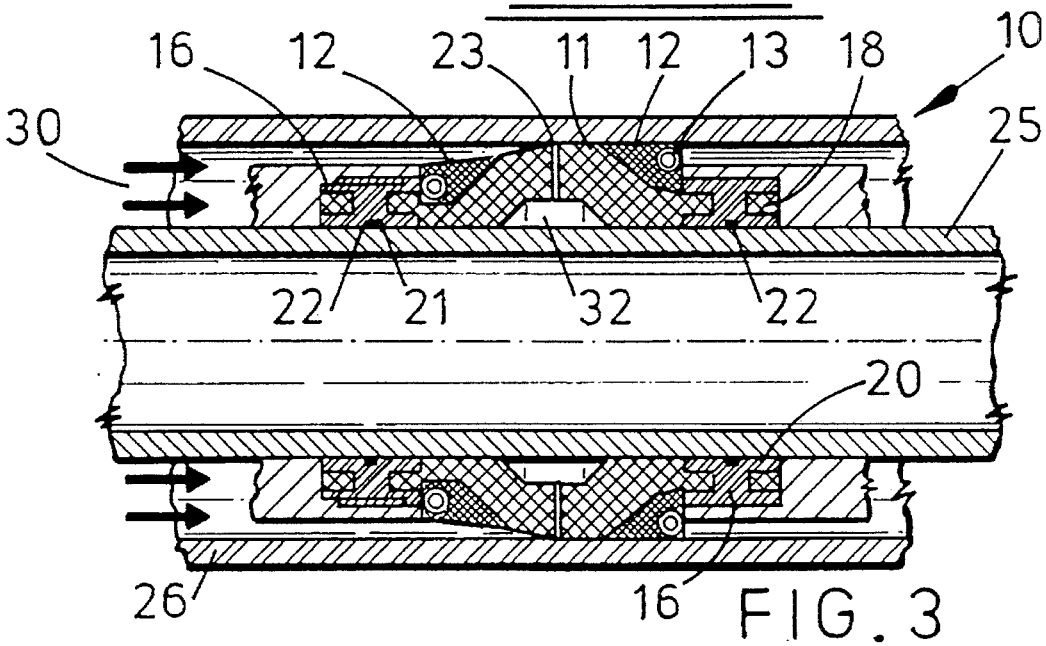

Embodiments of the present invention will now be described, by way of example, with reference to the accompanying drawings, in which:

FIG. 1 is a sectional side elevation of a pack-off element forming part of a downhole tool according to an embodiment of the present invention, the element shown in the retracted configuration; and FIG. 2 is an end elevation of a ring member of the element;

FIG. 3 corresponds to FIG. 1 though showing the pack-off element in an extended sealing configuration and subject to a external fluid pressure.

Referring to FIGS. 1 and 2 of the drawings, there is illustrated the pack-off element 10 of a downhole pack-off tool. The pack-off element 10 is tubular (cylindrical) and is located around a tubular member such as a mandrel 25. In FIG. 1 the pack-off element is shown separate from the mandrel 25. The element 10 comprises a main tubular body including a moulded expandable sealing element 11 of any suitable deformable material such as an elastomer.

The sealing element 11 forms the main part of the body of the pack-off element and includes annular inserts 12 at each end. These inserts 12 are formed of a stiffer material than that of the remainder of the sealing element 11. Bonded into each insert are a pair of co-axial circular springs 13 to aid retraction of the pack-off element 10 after use, and also to limit extrusion of the element 11. The inserts 12 are secured to the sealing element by any suitable adhesive or by bonding during moulding, each end of the sealing element tapering at 14 to form a seal for the inserts 12.

At each extreme end of the sealing element 11 a non-expandable ring member 16 is provided to reinforce the ends of the element 11 against possible distortion and also to provide seals between the main tubular body and the mandrel 25, as will be described.

Each ring member 16 is made of a rigid material such as steel and has two opposed annular faces 17 each defining a slot 18 into which material of the sealing element 11 extends during moulding to key the ring members to the sealing element. Apertures 18A extend through the ring members between the slots 18 to key the ring members more securely to the sealing element 11. The inner diameter of each ring member 16 is the same as that of the sealing element 11, or may be slightly larger to facilitate assembly, but the outer diameter is less than that of the sealing element, though further support for the element 11 is desirable to contain the element 11.

The inner face 20 of each ring member has an annular groove 21 which carries an O-ring 22 or similar seal to provide a seal with the mandrel 25.

One or more radial communicating bores 23 are provided to extend through the sealing element 11. The presence of the bores 23 prevents air becoming trapped between the tubular sealing element 11 and the mandrel 25 while running downhole, and facilitates the formation of a seal by the tool, as will be described.

Annular grooves or cut-outs 24 are provided in the inner surface of the tubular sealing element 11. On axial loading, the grooves 24 aid outward expansion of the sealing element.

In use, the tool is lowered down a tube or bore such as a well bore 26. At the desired depth, a relatively light axial force is applied to the pack-off element, for example by means of a slick line, and the sealing element 11 expands radially to abut the inner diameter of the well bore 26. Expansion of the element 11 is facilitated by the provision of the non-expandable ring members 16 which ensure that the ends of the element do not distort and the applied axial pressure is absorbed by the sealing element 11 in a controlled manner.

FIG. 3 of the drawings illustrates the effect of a relatively high pressure, indicated by arrows 30, on the element 11 and for ease of reference it will be assumed that the pressure is being applied from the upper end of the tool. The higher pressure fluid acting on the outer wall of the upper portion of the element 11 tends to deflect the element 11 inwardly (the deflection being shown somewhat exaggerated in FIG. 3) and communicates, through the communicating bores 23, with the space 32 between the mandrel 25 and the element 11, between the O-ring seals 22. The pressure then acts to push the lower portion of the element 11 into tighter engagement with the bore wall. Thus, the presence of a high pressure differential across the pack-off element 10 increases the initial light sealing force which acts between the expanded sealing element 11 and the bore 26, such that the element 11 is effectively self-sealing. The provision of the bores 23 thus considerably decreases the compression force which is required to set the pack-off tool to resist a predetermined pressure differential.

It will be clear to those of skill in the art that the above description is merely exemplary of the present invention, and that various modifications and improvements may be made to the illustrated example without departing from the scope of the invention; for example, the sealing element may be formed of two or more parts and a non-expandable part may be positioned between two expandable parts and the communicating bores provided therein.

I claim:

1. A pack-off tool comprising a main tubular body mounted on a mandrel, the body including an expandable sealing element having an integral non-expandable ring member at one end thereof for reinforcing the end of the element against distortion and including seal means for providing a sliding seal with the mandrel, a circular spring member being bonded into the sealing element at said one end, and a communicating bore toward the other end of the body and extending through the body, the tubular body being axially compressible to expand the sealing element into a radially extended configuration for sealing engagement with a bore wall and the communicating bore allowing higher pressure fluid from said other end of the tool to enter between the sealing element and the mandrel to exert radial pressure forces on a portion of the sealing element between the bore and the ring member to press the sealing element into tighter sealing engagement with the bore wall.

2. The tool of claim 1 in which a single expandable sealing element is provided and the communicating bore is provided in a central portion of the element.

3. The tool of claim 1 in which a further non-expandable ring member is integral with the expandable sealing element at the other end thereof.

4. The tool of claim 1 in which the seal means is an O-ring seal located in an annular groove formed in an inner face of the ring member.

5. The tool of claim 3, in which the ring members define opposed annular surfaces abutting the sealing element and said surfaces define slots to receive material of the sealing element therein to key the ring members to the sealing element.

6. The tool of claim 3, in which axial through holes (18A) are provided in the ring members (16) to receive material of the sealing element (11) therein.

7. The tool of claim 1 in which said circular spring member is contained in a material which is stiffer than the material of the remainder of the sealing element to aid retraction of the sealing element after use.

8. The tool of claim 7 in which said stiffer material is bonded to the expandable sealing element and defines an annular end portion of the sealing element.

9. The tool of claim 8 in which said end portion is externally mounted on the sealing element and tapers towards a central portion of the sealing element which is provided with a corresponding frusto-conical outer surface portion.

10. The tool of claim 7 in which said end portion abuts a ring member.

11. A pack-off tool comprising a main tubular body and a mandrel, the body including an expandable sealing element connected to a non-expandable ring member at one end of the body for reinforcing the end of the element against distortion, a circular spring member being bonded into the sealing element at or adjacent said one end, the spring member being contained in a material which is stiffer than the material of the remainder of the sealing element to aid retraction of the sealing element after use, and a communicating bore towards the other end of the body and extending through the body, the body being mounted on the mandrel and in sealing engagement therewith at least at said one end, the tubular body being axially compressible to expand the sealing element into a radially extended configuration for sealing engagement with a bore wall and the communicating bore allowing higher pressure fluid from said other end of the tool to enter between the sealing element and the mandrel to exert radial pressure forces on a portion of the sealing element between the bore and the ring member to press the sealing element into tighter sealing engagement with the bore wall.

* * * * *